United States Patent [19]

Schlage

[11] 4,107,968

[45] Aug. 22, 1978

[54] TALLY LOCK

[75] Inventor: Ernest L. Schlage, Burlingame, Calif.

[73] Assignee: Schlage Lock Company, San Francisco, Calif.

[21] Appl. No.: 800,580

[22] Filed: May 26, 1977

[51] Int. Cl.[2] ..... E05B 39/04

[52] U.S. Cl. ..... 70/436

[58] Field of Search ..... 70/436, 437, 432, 433, 70/434, 435

[56] References Cited

U.S. PATENT DOCUMENTS 3,221,526 12/1965 Stackhouse ..... 70/437

*Primary Examiner*—Robert L. Wolfe

*Attorney, Agent, or Firm*—Lothrop & West

[57] ABSTRACT

A tally lock has an enclosure frame adapted to be mounted on a door. A lock cylinder is disposed on the frame and carries a lock plug rotatable within the cylinder. At one end of the plug is a flange accessible through an opening in the frame and having a keyway therein into which extends a tab on a driver disc mounted for rotation in a ring on the frame. The driver disc has a flat and acts as a cam against a plate pivoted on the frame and connected by a pivoted link to a counter also mounted on the frame and disposed to display through another opening in the frame.

7 Claims, 6 Drawing Figures

FIG-6
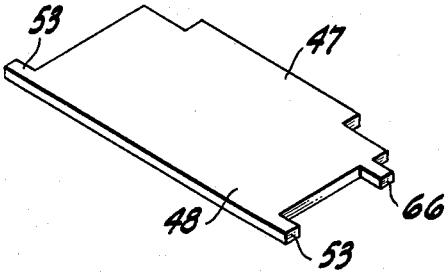
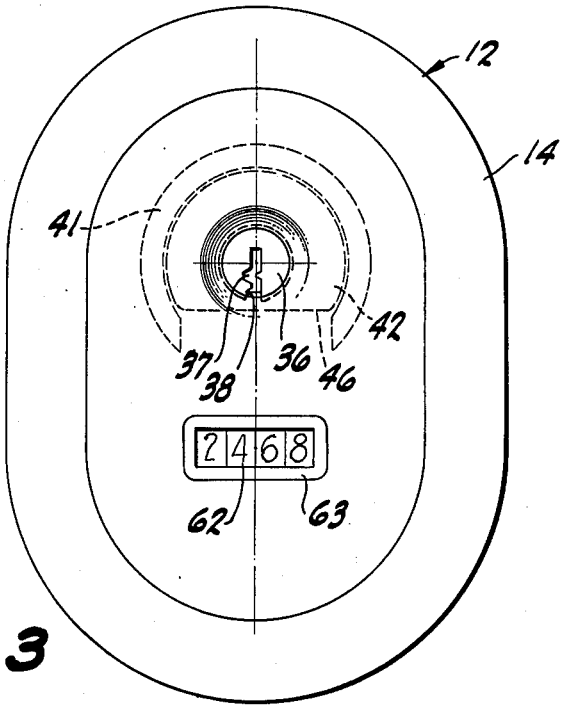
FIG-3
FIG-5
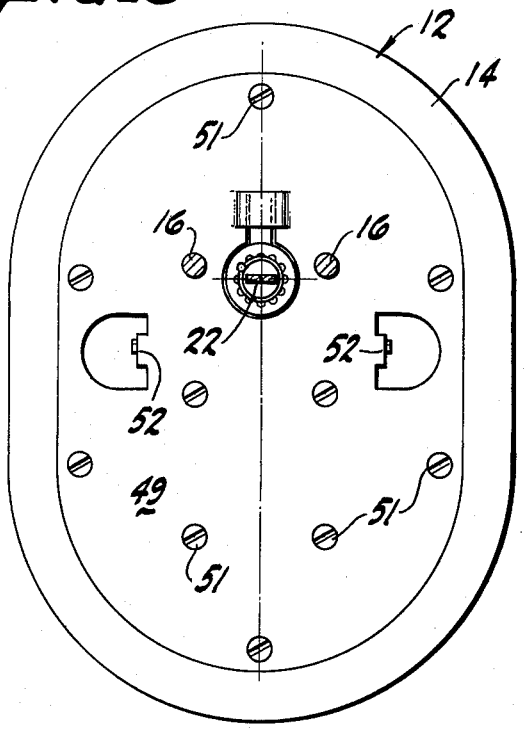
FIG-4
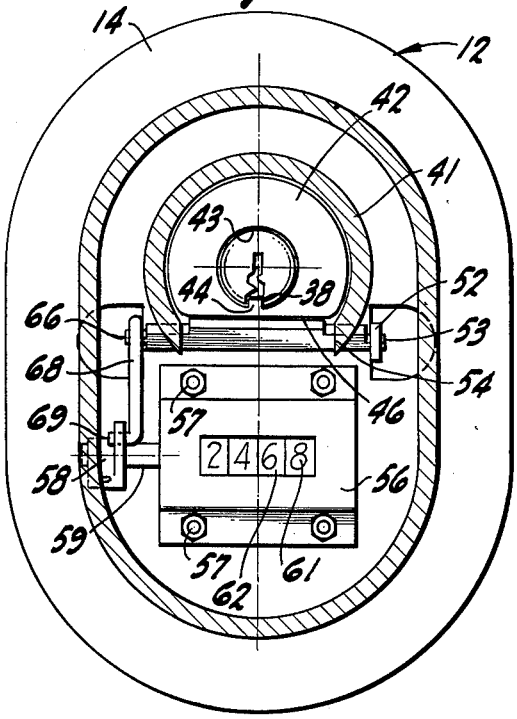

TALLY LOCK

BRIEF SUMMARY OF THE INVENTION

There is often a need to determine how many actuations have occurred in a particular lockset installation. This may be for the purpose of permitting a careful scrutiny to be kept of entries through the door controlled by the lock so that unauthorized or unwarranted incursions can be determined. There is a need for a tally lock of extremely simple and accurate construction that can be utilized in connection with presently existing lock mechanisms and with standard lock installations on door panels and one that can be visually inspected from time to time to determine the number of lock actuations. The installation is likewise preferably secure from tampering and false operation. To accomplish these operations there is provided a casing or enclosure mounted on a door and carrying the customary lock cylinder having a rotary plug in it. One end of the plug may be connected to an interior actuator, and the other end of the plug is provided with a flange. A keyway in the plug extends through the flange to leave a notch. A tab on a driver disc projects into the notch. The driver disc is mounted for rotation in the frame and has a cam or flat portion engageable with a motion transmitting mechanism extending to actuate a counter also mounted on the frame. The frame generally is closed except for one opening for the introduction of a key to the cylinder plug and another opening to reveal the visual display of the counter.

BRIEF DESCRIPTION OF THE SEVERAL VIEWS OF THE DRAWING

FIG. 3 is a front elevation of the tally lock itself.

FIG. 4 is a cross-section to a reduced scale, the plane of the section being indicated by the line 4—4 of FIG. 2.

FIG. 5 is a cross-section to a reduced scale, the plane of the section being indicated by the line 5—5 of FIG. 2.

FIG. 6 is an isometric perspective view of a pivoted plate forming part of the motion transmitting mechanism.

DETAILED DESCRIPTION

Figure 1:
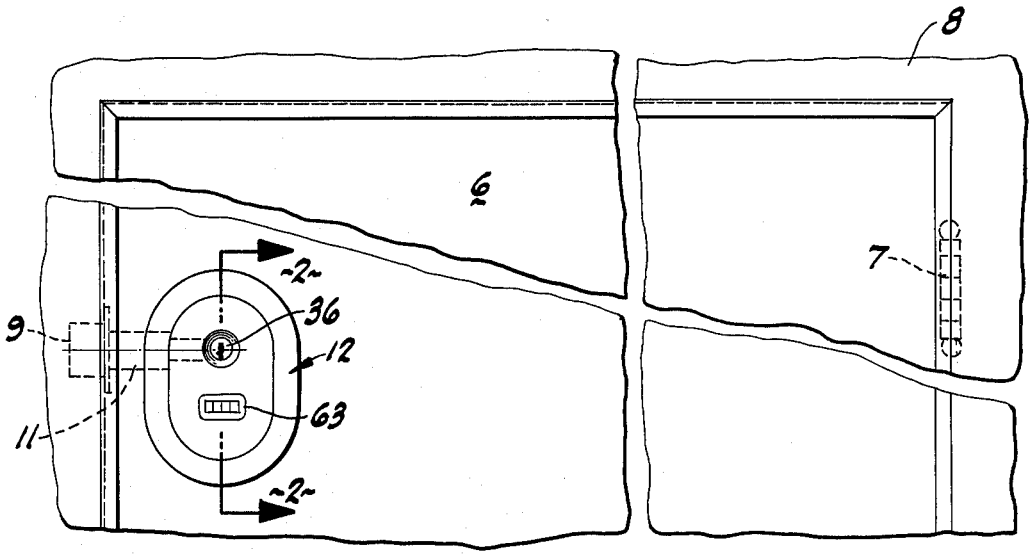
FIG. 1 is an elevation of a door panel mounted by hinges on a wall in the customary fashion with the tally lock of the invention installed thereon.

In a typical installation the tally lock of the invention is mounted on a door panel 6 supported in the customary way by hinges 7 within a door frame 8. The frame carries a strike device 9 for cooperating with a bolt 11 forming part of an adjacent lock mechanism 12 in the panel 6 and of any suitable sort. Preferably, the lock mechanism includes a frame 14 that is hollow and primarily is an enclosure for a tally lock mechanism. The frame is of sturdy and tamperproof construction and is preferably secured to the door panel 6 by extended screws 16 passing through an escutcheon 17 forming part of an interior finger turn 18. The screws 16 go through an opening 19 in the panel 6 and are threaded into the detachable cover 49. The screws extend through and also assist in supporting a bolt carrier 21 of the customary sort for mounting the bolt 11. A driver bar 22 joined to the finger turn 18 controls actuating mechanism 23 within the bolt carrier 21.

Pursuant to the present arrangement, the driver bar 22 also extends into one end of a cylinder plug 31 having the usual adjusting collar 32 at one end thereof. The plug 31 is rotatable in a cylinder body 33 or lock cylinder of the customary kind disposed mostly within an interior cavity 34 in the housing frame 14.

The cylinder plug 31 at its end opposite the collar 32 has a flange 36 intersected by a keyway 37 cut in the plug. In going through the flange 36, the keyway leaves a notch 38 in the flange in the rotary position normally utilized for the introduction and extraction of the actuating key.

The frame 14 is especially provided with an interrupted ring 41 within which is disposed a driver disc 42. The periphery of the disc is in bearing relationship with the interior of the ring 41, and the center of the disc is on the axis of rotation of the cylinder plug.

So that the disc and the plug rotate together, the disc is provided with a central opening 43 surrounding the flange 36 and also has a tab 44 fitting into the notch 38. Upon rotation of the plug, the disc is likewise rotated. The disc is non-circular and preferably has a substantially flat portion 46 thereon conveniently symmetrical with the keyway or key opening. The flat portion merges smoothly with the circular periphery of the disc. There remains a substantial circular portion of the disc rotatable in the ring and serving as a support for one end of the cylinder plug and through the plug as a support for the cylinder housing 33.

The flat portion 46 of the disc is close to and is intended to cam against a lip 47 forming an extended portion of a plate 48. Included in the frame 14 is a detachable cover 49 removably secured in position by fasteners 51 and at an appropriate location carrying a pair of ears 52. Lugs 53 forming part of the plate extend into holes in the ears and so mount the plate on the frame for pivotal movement. The lip operates in a cutaway portion 54 of the ring 41.

Figure 2:
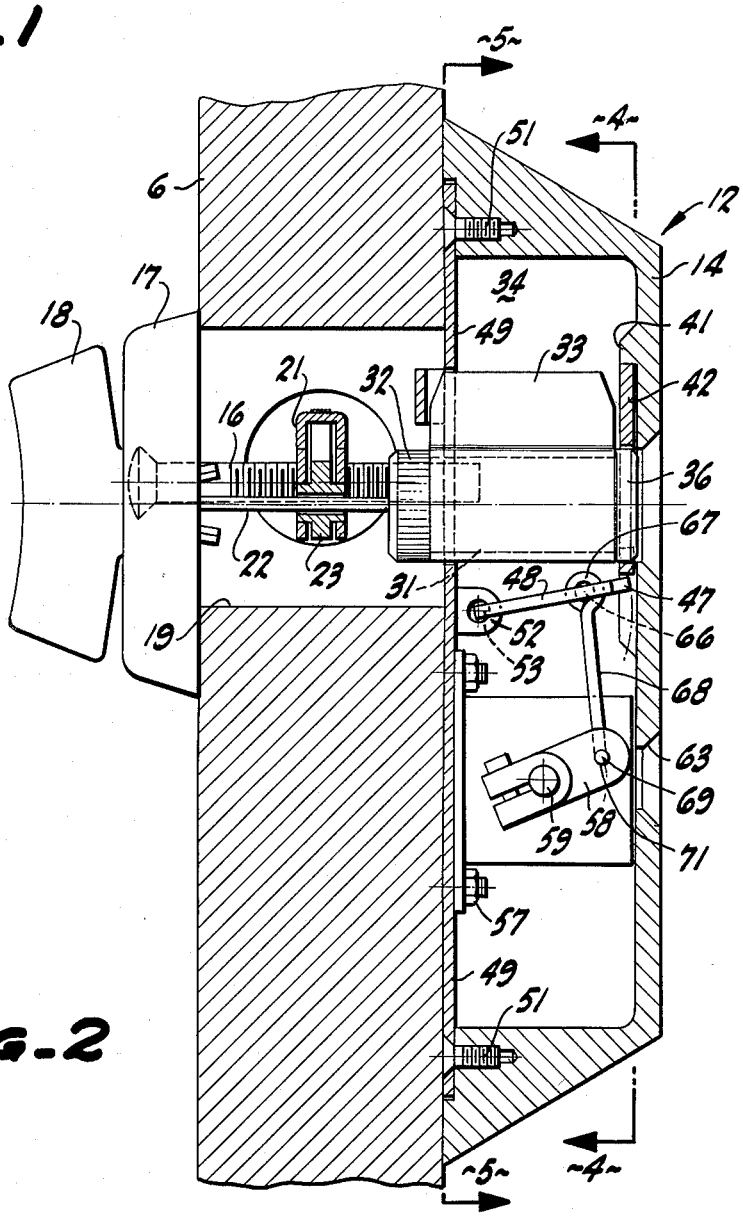
FIG. 2 is a cross-section to an enlarged scale, the plane of section being indicated by the line 2—2 of FIG. 1.

Also mounted on the cover 49 is a counter 56 of a standard kind secured in position by fasteners 57. The counter is actuable by a lever 58 secured to a shaft 59. The shaft is spring-impelled to move the lever 58 into an upper position, as shown in FIG. 2, but when the lever 58 is mechanically moved downwardly, clockwise in FIG. 2, through a limited arc, the counter is actuated to advance numeral wheels 61 in the counter display 62. The mounting of the counter is such that the display 62 is readily visible through an opening 63 in the frame 14. In this way inspection is facilitated. The counter mechanism blocks access through the opening 63 to the interior of the structure. It is not possible to actuate the counter except by oscillation or pivotal movement of the plate 48. Operation is accomplished by a lug 66 on the plate operating within a loop 67 forming a pivotal connection between the plate and a link 68 having a hook 69 at its other end entering into an opening 71 in the lever 58.

With this mechanism, when the cylinder plug is rotated by a key in the keyway 37, rotation of the plug flange produces a similar rotation of the driver disc 42 by virtue of interengagement of the tab 44 in the notch 38. Since the flat 46 is normally adjacent the lip 47, upon rotation of the disc a larger diameter portion of the disc cams against the lip and depresses the plate. This motion, through the link 68, performs one actuation of the lever 58 and advances the counter display one unit. When the key in the plug is rotated back to its initial position, the disc 42 is returned substantially to the location shown in FIG. 4, and the spring return of the counter moves the lever 58 back to initial position.

With this mechanism, the number of actuations of the lock by the cylinder plug is readily discerned by visual inspection at any time.

I claim:

1. A tally lock comprising a frame, a lock cylinder, a lock plug having a key opening in one end thereof and rotatable in said cylinder away from and toward a central position, a plug flange on said plug at the key opening end thereof, means for mounting said lock cylinder on said frame, a counter, means for mounting said counter on said frame, a rotary driver disc having a flat thereon symmetrical in said central position and disposed on and rotatable with said plug flange, a follower mounted on said frame symmetrically with said central position and in the path of rotation of said flat on said disc, and means operated by said follower for actuating said counter.

2. A device as in claim 1 in which said plug flange has at least a portion of said key opening therein and said rotary driver disc has a central opening surrounding said plug flange and has a tab extending into said portion of said key opening.

3. A device as in claim 1 in which said follower is a plate engaging said driver disc and including means for mounting said plate for pivotal motion on said frame.

4. A device as in claim 3 in which said counter has an actuating lever and including a link pivotally connected to said plate and to said lever.

5. A tally lock comprising a frame in the form of an enclosure adapted to be mounted on a door panel, a lock cylinder, a lock plug rotatable in said cylinder, a rotating connection at one end of said plug, a flange on the other end of said plug, means defining a first opening in said frame, means for mounting said cylinder on said frame with said flange accessible through said first opening, means defining a second opening in said frame, a counter, an operating lever on said counter, means for mounting said counter on said frame with the display of said counter exposed through said second opening, a driver disc, means for supporting said driver disc for rotation on said frame, means for coupling said driver disc and said plug for rotation together, a plate, means for mounting said plate for pivotal movement on said frame and in the path of movement of said driver disc, and means for interconnecting said plate and said operating lever on said counter.

6. A device as in claim 5 including a ring on said frame and in which said driver disc is disposed with the periphery thereof in bearing engagement with said ring, and in which said driver disc has a lug in engagement with said flange connecting said disc and said flange for rotation together, and in which the periphery of said disc is disposed to cam against said plate.

7. A tally lock comprising a frame, a ring on said frame, a lock cylinder, a lock plug having a key opening in one end thereof and rotatable in said cylinder, a flange on said lock plug, a disc surrounding and engaging said flange and rotatably bearing on said ring, means on said disc extending into said key opening, a counter, means for mounting said counter on said frame, and means operated by said disc for actuating said counter.

* * * * *